US006237565B1

(12) United States Patent
Engelgau

(10) Patent No.: US 6,237,565 B1
(45) **Date of Patent: *May 29, 2001**

(54) ADJUSTABLE PEDAL ASSEMBLY WITH ELECTRONIC THROTTLE CONTROL

(75) Inventor: Steven J. Engelgau, Royal Oak, MI (US)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/643,422

(22) Filed: Aug. 22, 2000

Related U.S. Application Data

(63) Continuation of application No. 09/236,975, filed on Jan. 26, 1999, now Pat. No. 6,109,241.

(51) Int. Cl.[7] ..... F02D 1/00
(52) U.S. Cl. ..... 123/399; 74/560
(58) Field of Search ..... 123/399; 74/560

(56) References Cited

U.S. PATENT DOCUMENTS 4,470,570 9/1984 Sakurai et al. ..... 244/235
5,056,742 10/1991 Sakurai ..... 244/235

*Primary Examiner*—John Kwon
(74) *Attorney, Agent, or Firm*—Howard & Howard

(57) ABSTRACT

A vehicle control pedal apparatus (12) includes a support (18) adapted to be mounted to a vehicle structure (20) and an adjustable pedal assembly (22) having a pedal arm (14) that is moveable in fore and aft directions with respect to the support (18). A pivot (24) pivotally supports the adjustable pedal assembly (22) with respect to the support (18) and defines a pivot axis (26). The control pedal apparatus (12) further includes an electronic throttle control (28) attached to the support (18) for controlling an engine throttle (30). The apparatus (12) is characterized by the electronic throttle control (28) being responsive to the pivot (24) for providing a signal (32) that corresponds to pedal arm position as the pedal arm (14) pivots about the pivot axis (26) between rest and applied positions, Thus, the control pedal apparatus (12) can adjust pedal arm position in fore and aft directions without having to move the electronic throttle control unit (28) along with the pedal arm (14). Additionally, the electronic throttle control (28) is responsive to the pivot (24) about which the adjustable pedal assembly (22) rotates.

4 Claims, 4 Drawing Sheets

12
78
22
66
62
20
64
46
14
70
24
18
28
14

ADJUSTABLE PEDAL ASSEMBLY WITH ELECTRONIC THROTTLE CONTROL

RELATED APPLICATION

This application is a continuation of application Ser. No. 09/236,975, filed Jan. 26, 1999, U.S. Pat. No. 6,109,241.

TECHNICALLY FIELD

The subject invention relates to vehicle control pedal assembly having an adjustment mechanism for moving a pedal arm in fore and aft directions and an electronic throttle control for controlling an engine throttle. Specifically, the pedal assembly includes a pivot about which the adjustment mechanism rotates when the pedal arm is actuated and which provides input to the electronic throttle control for providing a signal that corresponds to pedal arm position.

BACKGROUND OF THE INVENTION

Pedal assemblies are used in vehicles to control the movement of the vehicle. For example, a vehicle driver applies a force to an accelerator pedal to move the pedal from a rest position to an applied position. In the applied position, the accelerator pedal typically actuates an engine throttle, which controls the acceleration and speed of the vehicle. Often these pedal assemblies include an adjustment apparatus that allows the position of a pedal arm and/or a pedal pad to be moved with respect to the driver. This allows the pedal assembly to accommodate drivers of various heights. Thus, the adjustment apparatus allows the pedal assembly to be moved closer to the driver when the driver is short and allows the pedal assembly to be moved further away from the driver when the driver is tall. Examples, of adjustable pedal assemblies are shown in U.S. Pat. Nos. 5,460,061 and 5,632,183 all assigned to the assignee of the subject invention.

Additionally, adjustable pedal assemblies can include an electronic throttle control assembly for a drive-by-wire system. The electronic throttle control assembly is used to generate an electrical signal that corresponds to the position of the accelerator pedal. The electronic throttle control assembly replaces traditional mechanical linkages between the pedal arm and the engine throttle. One such adjustment apparatus used with an electronic throttle control is shown in U.S. Pat. No. 5,819,593 assigned to the assignee of the present invention.

When a vehicle control pedal assembly includes both an adjustment apparatus and an electronic throttle control, the pedal assembly can be complex with a great number of parts. These control pedal assemblies can be expensive, time consuming to assemble, and require a significant amount of packaging space.

SUMMARY OF THE INVENTION AND ADVANTAGES

A vehicle control pedal apparatus includes a support adapted to be mounted to a vehicle structure and an adjustable pedal assembly with a pedal arm that is moveable in fore and aft directions with respect to the support. A pivot pivotally supports the adjustable pedal assembly with respect to the support and defines a pivot axis. The control pedal apparatus further includes an electronic throttle control attached to the support for controlling an engine throttle. The apparatus is characterized by the electronic throttle control being responsive to the pivot for providing a signal corresponding to pedal arm position as the pedal arm pivots about the pivot axis between rest and applied positions. Accordingly, the subject invention provides a simplified vehicle control pedal assembly that is less expensive, and which uses fewer parts and is easier to package within the vehicle.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
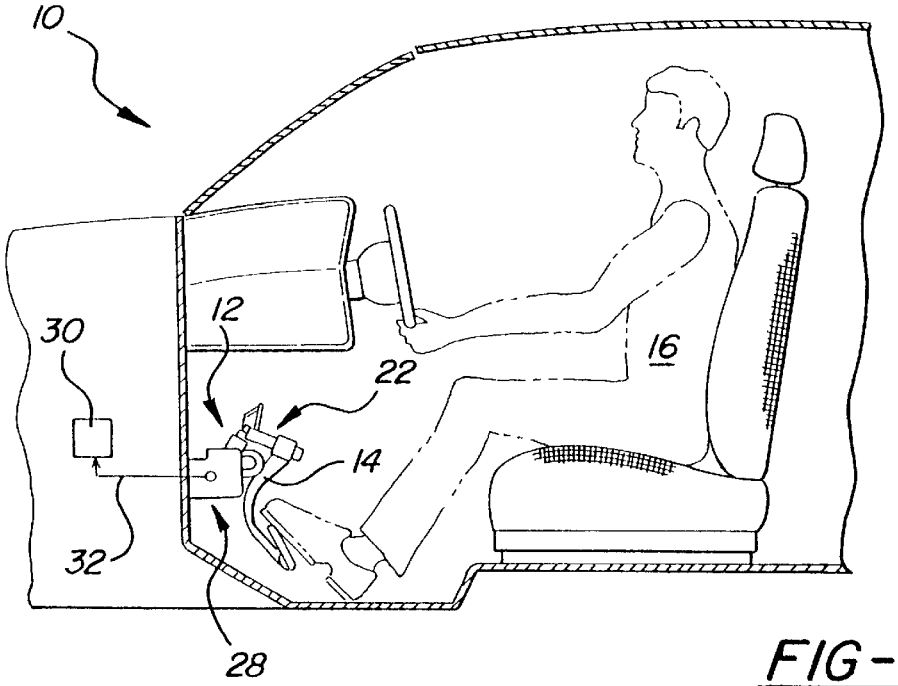
FIG. 1 is a side view of a vehicle, partially in cross-section, including the subject pedal assembly.

Referring to the Figures, wherein like numerals indicate like or corresponding parts throughout the several views, a vehicle 10 with a control pedal apparatus 12 is shown in FIG. 1. The control pedal apparatus 12 includes a pedal arm 14 that can be adjusted in fore and aft directions with respect to the vehicle 10 by a driver 16. This adjustment capability allows the pedal arm 14 to be positioned to accommodate drivers 16 of various heights.

The vehicle control pedal apparatus 12 includes a support 18 adapted to be mounted to a vehicle structure 20 such as a firewall or dash member, for example. The support 18 can be a bracket, housing, or other structural support member known in the art. The support 18 can be a unitary member that is attached directly to the vehicle structure 20 or the support 18 can be comprised of a plurality of support members, one of which is attached to the vehicle structure 20.

Figure 3:
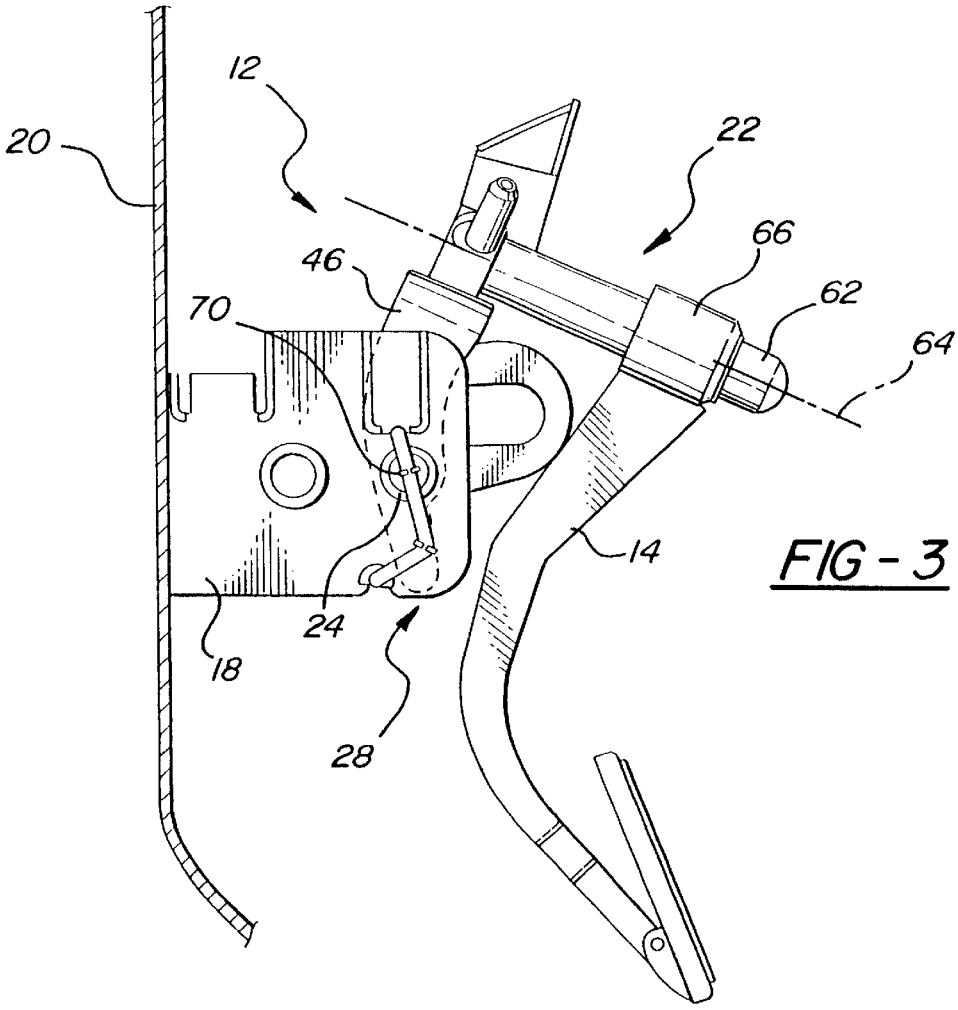
FIG. 3 is a side view of the subject pedal assembly in a pivoted position.
Figure 2:
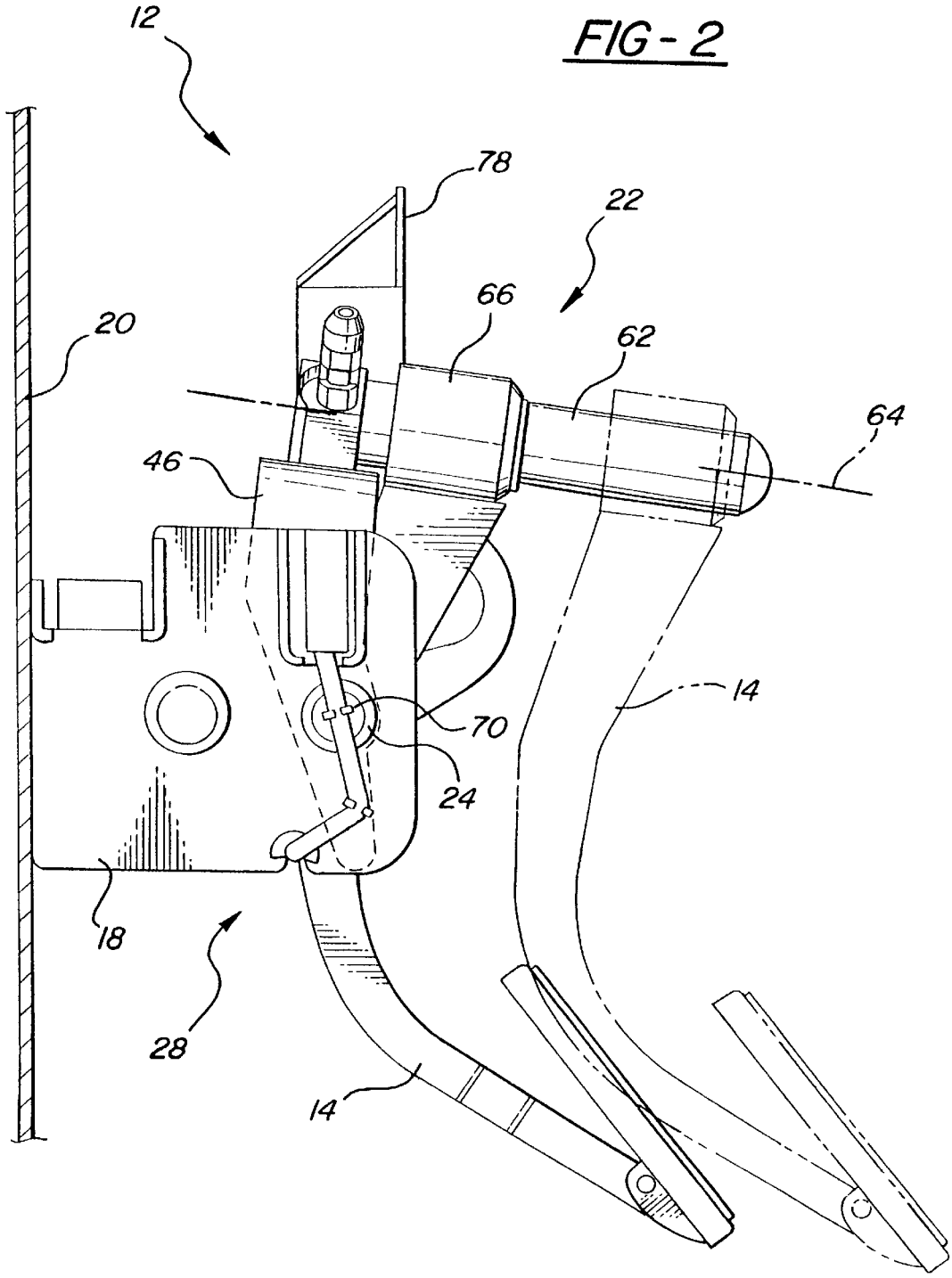
FIG. 2 is a side view of the subject pedal assembly showing a pedal arm in fore and aft positions.

As shown in FIGS. 2 and 3, the control pedal apparatus 12 further includes an adjustable pedal assembly 22 with a pedal arm 14 that is moveable in fore and aft directions with respect to the support 18. In FIG. 2, the pedal arm 14 is shown in the furthest adjustment position in the fore direction in solid lines and in the furthest adjustment position in the aft direction in dashed lines. The adjustable pedal assembly 22 preferably includes an electric motor (not shown) for controlling the movement of the pedal arm 14 in the fore and aft directions, as is well known in the art. The adjustable pedal assembly 22 can be any of various adjustable pedal assemblies known in the art. For example, the adjustable pedal assembly 22 could be similar to the adjustable pedal assembly in U.S. Pat. No. 5,632,183 assigned to the assignee of the present invention and incorporated herein by reference.

Figure 5:
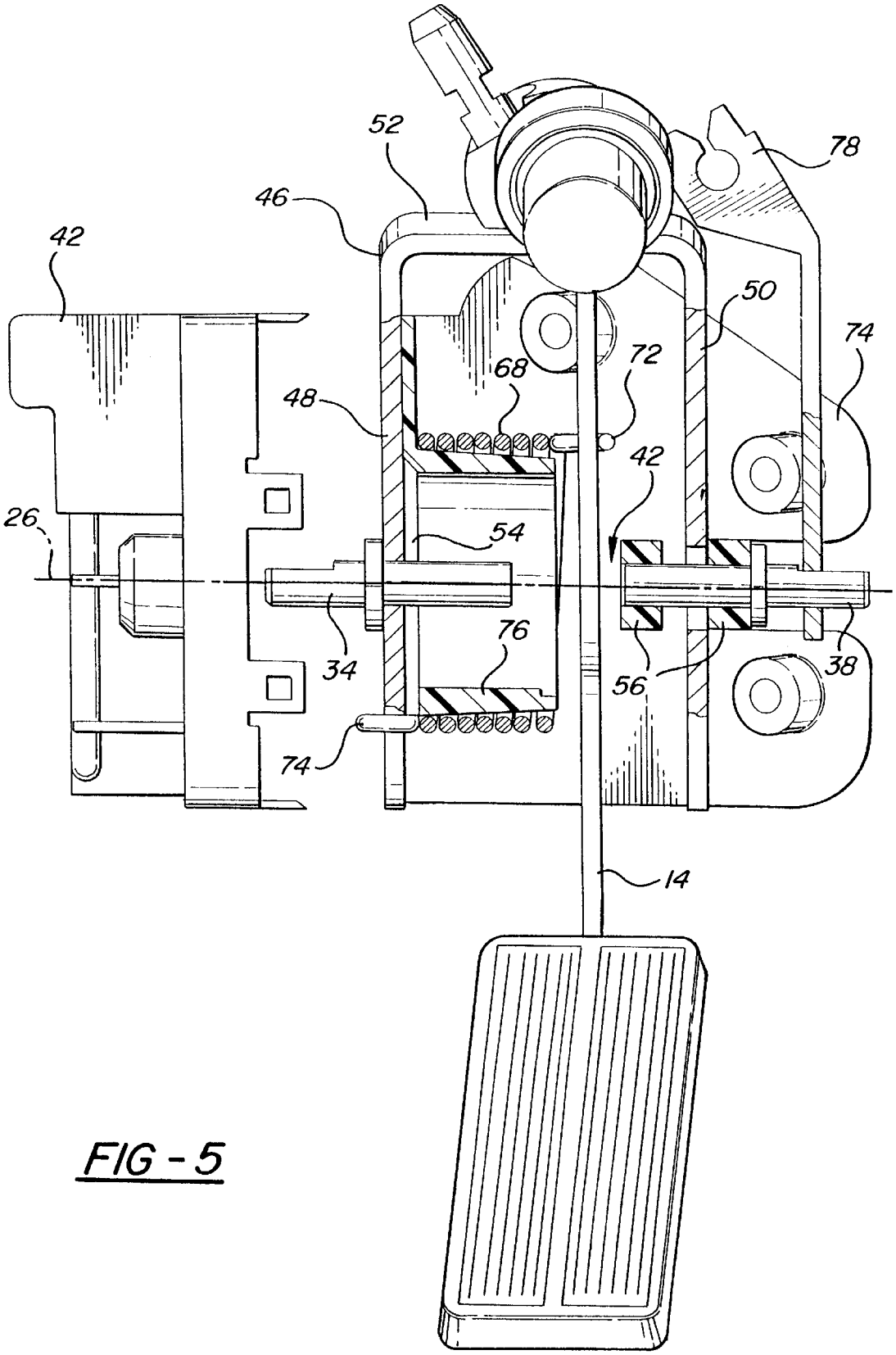
FIG. 5 is a front view, partially in cross-section , of the pedal assembly shown in FIG. 3.

A pivot 24 pivotally supports the adjustable pedal assembly 22 with respect to the vehicle structure 20 and defines a pivot axis 26 (shown in FIG. 5). The pivot 24 is preferably comprised of a first pivot member 34 defining a first pivot member axis 36 and a second pivot member 38 defining a second pivot member axis 40. The first 36 and second 40 pivot member axes are collinear to define the pivot axis 26.

While two pivot members 34, 38 are preferred a single pivot could be used or additional pivot members could be used to provide additional pivotal support.

The first 34 and second 38 pivot members are longitudinally spaced apart from one another to define a clearance space 42 for the pedal arm 14 as the pedal arm 14 pivots about the pivot axis 26. Thus, when the pedal arm 14 is moved from a rest position to an applied position, as shown in FIG. 3, the pedal arm 14 can move between the first 34 and second 38 pivot members without coming into contact with the pivot members 34, 38. If only a single pivot member is used, the clearance space 42 between pivot members is not needed.

The control pedal apparatus 12 also includes an electronic throttle control mechanism 28 attached to the vehicle structure 20 for controlling an engine throttle 30 shown schematically in FIG. 1. The electronic throttle control 28 is responsive to the pivot 24 and provides a signal 32 that corresponds to pedal arm position as the pedal arm 14 pivots about the pivot axis 26 between rest and applied positions. Thus, the signal 32 will vary as the pedal arm 14 moves from the rest position to the applied position. The electronic throttle control mechanism 28 can be any of various electronic throttle control mechanisms known in the art, as the one described in U.S. Pat. No. 5,819,593 assigned to the assignee of the present invention and incorporated herein by reference.

The electronic throttle control 28 is preferably responsive to the first pivot member 34 to provide the signal 32 that corresponds to pedal arm position. The second pivot member 38 preferably provides pivotal balance for the pedal arm 14 as the pedal arm 14 pivots about the pivot axis 26. It should be understood however that the electronic throttle control 28 could also be mounted on the opposite side of the control pedal assembly 12 such that the second pivot member 38 provides input to product the signal 32 while the first pivot member 34 provides additional balance for the pedal arm 14 as it pivots.

Figure 4:
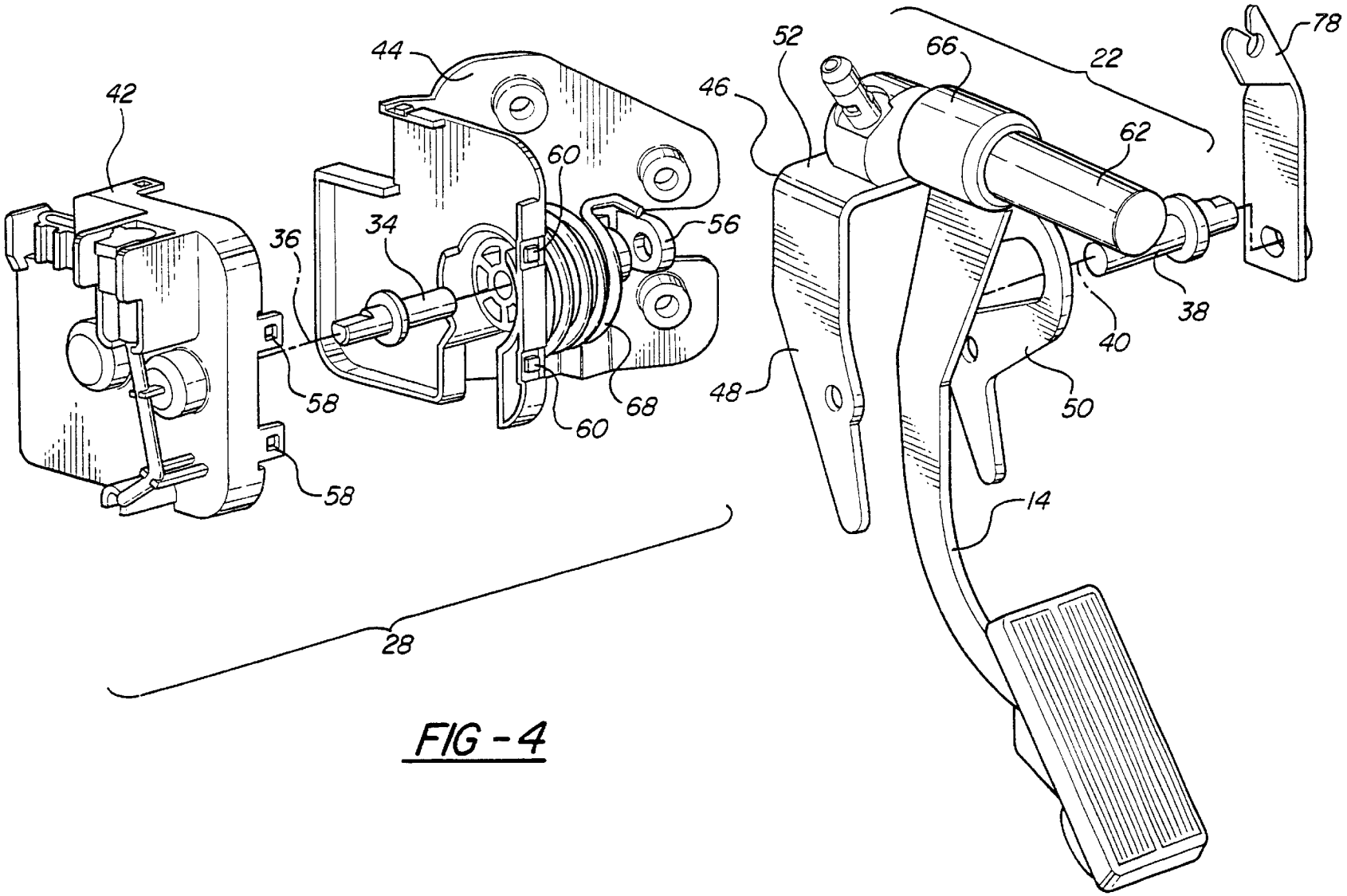
FIG. 4 is an exploded view of the pedal assembly shown in FIG. 3.

The electronic throttle control mechanism 28 preferably includes a first housing portion 42 and a second housing portion 44, shown in FIG. 4. In the preferred embodiment the housing portions 42, 44 partially serve as the support 18 for the control pedal apparatus 12 and are fixed relative to the vehicle structure 20. The adjustable pedal assembly 22 is supported on a bracket 46 that is mounted to the housing portions 42, 44. The second housing portion 44 includes a first pivotal support 54 and a second pivotal support 56. The first pivotal support 54 receives the first pivot member 34 and the second pivotal support 56 receives the second pivot member 38. As discussed above, the first 34 and second 38 pivot members form the pivot 24 about which the pedal arm 14 pivots.

The bracket 46 includes a first leg 48 and a second leg 50 that extend downwardly from a central base member 52. While the bracket 46 is shown with two legs 48, 50, the bracket 46 could also be configured to have only a single leg or could have additional leg members. The bracket 46 need only provide partial support for the adjustable pedal assembly 22.

The bracket 46 is partially installed within the second housing member 44 such that the first pivotal support 54 is adjacent to the first leg 48 and the second pivotal support 56 is adjacent to the second leg 50. The first housing portion 42 is attached to the second housing portion near the first pivotal support 54 to enclose the electronic throttle control 28. The first housing portion 42 preferably includes tab receivers 58 for snap fit attachment to tabs 60 located on the second housing portion 44.

The bracket 46 pivots about the pivot axis 26 when a force is applied to the pedal arm 14 to move the pedal arm 14 from the rest to the applied position. The electronic throttle control 28 is fixed with respect to the vehicle structure 20 such that the pedal arm 14 moves in fore and aft directions with respect to the electronic throttle control 28 and with respect to the vehicle structure 20. Thus, the adjustable pedal assembly 22 pivots with respect to the vehicle structure 20 and moves the pedal arm 14 in fore and aft directions with respect to the vehicle structure 20, while the electronic throttle control 28 remains fixed with respect to the vehicle structure 20. In other words, the pedal arm 14 moves independently from the electronic throttle control 28. Additionally, the pedal arm 14 moves in fore and aft directions with respect to the pivot 24.

The adjustable pedal assembly 22 includes a guide rod 62 for supporting the pedal arm 14 and which defines a longitudinal axis 64. The pedal arm 14 moves in the fore and aft directions along the longitudinal axis 64. The longitudinal axis 64 is perpendicular to the pivot axis 26. Thus, the guide rod 62 is rotatable about the pivot axis 26 along with the bracket 46 when the pedal arm 14 pivots about the pivot axis 26.

The adjustable pedal assembly 22 further includes a bearing member 66 for slidably supporting the pedal arm 14 on the guide rod 62. The bearing member 66 is preferably a bushing, however, other bearing members well known in the art can be used. In the preferred embodiment, an electric motor is used to drive a screw drive mechanism housed within the guide rod 62, which causes the bearing member 66 and the pedal arm 14 to move along the guide rod 62.

The control pedal apparatus 12 also includes a resilient member 68, shown in FIG. 5, which reacts between the pedal arm 14 and the bracket 46 for providing resistance as the pedal arm 14 is moved from the rest position to the applied position. This resistance provides a "feel" 16 as the pedal arm 14 pivots that corresponds to the feel that a driver experiences in pedal assembly having a cable assembly as part of a mechanical link to the engine throttle 30. The resilient member 68 is preferably a coil spring with a spring center 70 that is concentric with the pivot 24. The spring 68 has a first spring end 72 engaging the pedal arm 14 and a second spring end 74 engaging the bracket 46. In addition to providing resistance as the pedal arm 14 is moved to the applied position, the spring 68 returns the pedal arm 14 to the rest position after a force applied to the pedal arm 14 has been removed.

The spring 68 is supported by a cylindrical portion 76 that extends inwardly from the second housing portion 44 of the electronic throttle control 28, toward the pedal arm 14. Thus, the cylindrical portion 76 is located between the pedal arm 14 and the first leg 48 of the bracket 46.

While the spring 68 is shown as a coil spring that is supported about pivot 24, other spring configurations known in the art could also be used. Also, the spring 68 could be located at a position other than about pivot 24. The main function of the spring 68 is to act upon the pedal arm 14 to provide a feel to the driver as the pedal arm 14 pivots.

A cable attachment member 78 can optionally be supported on one of the pivot members 34, 38 to support a cable assembly for attachment to the engine throttle 30. This configuration would be used in place of the electronic throttle control 28; i.e., the configuration is used with a pedal assembly having a mechanical link to the throttle.

The control pedal apparatus 12 of the subject invention provides both an adjustment apparatus 22 and an electronic throttle control 28 in an assembly that requires less packaging space and which requires fewer components than prior art control pedals. This reduces overall assembly time and reduces material costs. The control pedal apparatus 12 provides the additional benefits of having a single pivot (24) to pivotally support the pedal arm 14 in addition to providing input to the electronic throttle control 28. Thus, the control pedal apparatus 12 allows adjustment of the pedal arm 14 in fore and aft directions without having to move the electronic throttle control unit 28 along with the pedal arm 14, and the electronic throttle control 28 is responsive to the pivot 24 about which the adjustable pedal assembly 22 rotates.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An adjustable pedal assembly for a vehicle comprising;

a support (18) for mounting to a vehicle structure;

an adjustable pedal assembly (22) having a guide member (62) rotatably supported by said support (18) for pivotal movement about a pivot axis (26); and a pedal arm (14) supported on said guide member (62) for rectilinear movement in fore and aft directions relative to said support (18), said guide member (62) and said pivot axis (26) between various adjusted positions;

an electronic control (28) supported on said support (18) and responsive to pivotal movement of said pedal arm (14) and said guide member (62) about said pivot axis (26), said electronic control (28) being fixed relative to said support (18) such that said pedal arm (14) moves in fore and aft directions with respect to said electronic control (28), said electronic control (28) being responsive to pivotal movement of said guide member (62) about said pivot axis (26) for providing a signal (32) that corresponds to pedal arm (14) position as said pedal arm (14) pivots said guide member (62) about said pivot axis (26).

2. An assembly as set forth in claim 1 wherein said pedal arm (14) is in sliding engagement with said guide member (62) and extends from said guide member (62) to lower pad end.

3. An assembly as set forth in claim 2 including a drive for moving said pedal arm (14) along said guide member (62).

4. A vehicle control pedal apparatus (12) comprising:

a support (18) adapted to be mounted to a vehicle structure (20);

an adjustable pedal assembly (22) having a pedal arm (14) moveable in force and aft directions with respect to said support (18);

a pivot (24) for pivotally supporting said adjustable pedal assembly (22) with respect to said support (18) and defining a pivot axis (26); and an electronic control (28) attached to said support (18) for controlling a vehicle system;

said apparatus (12) characterized by said electronic control (28) being responsive to said pivot (24) for providing a signal (32) that corresponds to pedal arm position as said pedal arm (14) pivots about said pivot axis (26) between rest and applied positions wherein the position of said pivot (24) remains constant while said pedal arm (14) moves in fore and aft directions with respect to said pivot (24).

* * * * *

UNITED STATES PATENT AND TRADEMARK OFFICE

CERTIFICATE OF CORRECTION

PATENT NO. : 6,237,565 B1
DATED : May 29, 2001
INVENTOR(S) : Steven J. Engelgau

It is certified that error appears in the above-identified patent and that said Letters Patent is hereby corrected as shown below:

Column 6,
Line 21, please change “force” to -- fore --.

Signed and Sealed this

Fourth Day of February, 2003

JAMES E. ROGAN
*Director of the United States Patent and Trademark Office*